US007365697B2

(12) United States Patent
Naito

(10) Patent No.: US 7,365,697 B2
(45) Date of Patent: Apr. 29, 2008

(54) CARD TYPE WIRELESS DEVICE, ANTENNA COIL, AND METHOD FOR MANUFACTURING COMMUNICATION MODULE

(75) Inventor: Hiromichi Naito, Okazaki (JP)

(73) Assignee: Denso Corporation, Kariya, Aichi-pref. (JP)

( * ) Notice: Subject to any disclaimer, the term of this patent is extended or adjusted under 35 U.S.C. 154(b) by 0 days.

(21) Appl. No.: 11/429,241

(22) Filed: May 8, 2006

(65) Prior Publication Data

US 2006/0267854 A1 Nov. 30, 2006

(30) Foreign Application Priority Data

May 31, 2005 (JP) ..... 2005-158915

(51) Int. Cl.
*H01Q 7/08* (2006.01)

(52) U.S. Cl. ..... 343/788; 343/895

(58) Field of Classification Search ..... 343/787, 343/788, 741, 718, 895
See application file for complete search history.

(56) References Cited

U.S. PATENT DOCUMENTS 5,321,240 A 6/1994 Takahira et al.
5,864,323 A * 1/1999 Berthon ..... 343/788
6,046,584 A 4/2000 Nakane et al.
6,194,893 B1 2/2001 Yokotani et al.
6,291,990 B1 9/2001 Nakane et al.
6,452,381 B1 9/2002 Nakatani et al.
6,924,767 B2 8/2005 Kitahara et al.
7,050,007 B2 * 5/2006 Akiho et al. ..... 343/702
2005/0040997 A1 * 2/2005 Akiho et al. ..... 343/866
2005/0270249 A1 * 12/2005 Saegusa et al. ..... 343/788

FOREIGN PATENT DOCUMENTS

JP 2002-271127 9/2002
JP 2004-64193 2/2004
JP 2005-210223 8/2005

* cited by examiner

*Primary Examiner*—Hoanganh Le
(74) *Attorney, Agent, or Firm*—Nixon & Vanderhye P.C.

(57) ABSTRACT

An antenna coil includes: an air-core type flat coil body; a coil case; and a reinforce frame. The coil case has a ring shape, which corresponds to the coil body. The coil case includes a coil accommodation space. The coil case further includes a coil side terminal. The reinforce frame is integrated with the coil case along with the circumferential direction of the ring shape of the coil case. The reinforce frame is made of a material having a Young' modulus higher than that of the resin of the coil case.

19 Claims, 8 Drawing Sheets

CARD TYPE WIRELESS DEVICE, ANTENNA COIL, AND METHOD FOR MANUFACTURING COMMUNICATION MODULE

CROSS REFERENCE TO RELATED APPLICATION

This application is based on Japanese Patent Application No. 2005-158915 filed on May 31, 2005, the disclosure of which is incorporated herein by reference.

FIELD OF THE INVENTION

The present invention relates to a card type wireless device, an antenna coil, and a method for manufacturing a communication module.

BACKGROUND OF THE INVENTION

In recent years, an electronic key system (also called a smart entry system, etc.) is spread. In this electronic key system, ID authentication is performed by wireless communication between this system and a wireless electronic key (also called a portable device) carried by a user. Further, controls of locking/unlocking of a door lock, engine starting, etc. can be performed by commands from this portable device. In the above wireless electronic key, a demand for constructing this wireless electronic key as the card type wireless device made thin is raised to improve carrying convenience property by storing this wireless electronic key into a purse, etc. with a dramatic spread of an IC card, etc. as the background (3 mm or more and 5 mm or less in thickness).

The above electronic key system adopts a communication system able to execute a control operation such as the locking/unlocking of the door lock and the engine starting if the user approaches the automobile within a constant distance even when no user performs a special button operation, etc. with respect to the wireless electronic key. Concretely, a request radio wave sent out of the automobile side in one direction is received. ID authentication information, control command information relating to the above locking/unlocking or the engine starting, etc. are superposed on the transmitted radio wave and are sent out to the automobile side. In this case, when the user is distantly located, the wireless electronic key and the automobile do not react on communication. On the other hand, when the user approaches, there are many cases in which near distance type direct communication using a low frequency band (50 kHz or more and 500 kHz or less) is adopted so as to detect the radio wave by detouring the radio wave even when the user holds the wireless electronic key in any portion of the user's body.

The radio wave of the low frequency band has a very long wavelength. Therefore, in an antenna used for this radio wave, a so-called LF (Low Frequency) antenna provided by combining an antenna coil and a capacitor resonantly coupled to this antenna coil in a desirable frequency band is normally adopted. When the LF antenna is assembled into the card type wireless device, it is also necessary to reduce the thickness of this antenna coil in conformity with the thickness of a box body of the card type (e.g., 1 mm or more and 3 mm or less). In this case, it is desirable to mount the antenna coil onto a substrate in a shape for largely setting the aperture diameter of the antenna coil as much as possible to raise sensitivity with respect to the radio wave perpendicularly incident to the substrate face. It is effective to adopt the antenna coil with a core of high inductance so as to raise an antenna gain. However, a flat ferrite core is small in mechanical strength, and a crack, a fragment, etc. are easily caused by handling, etc. at a coil winding time. Accordingly, an air-core coil is normally adopted.

In the above-mentioned antenna coil, a demand for constructing this antenna coil as a surface mounting type discrete part is also raised from a viewpoint for improving productivity. Concretely, a coil main body is wound around a bobbin manufactured by resin, or the coil main body wound in outer setup is packaged in a case manufactured by resin to cope with such a demand. In the antenna coil formed as the discrete part in this way, a coil side terminal portion is positioned onto a substrate side pad through solder paste. Soldering processing is then performed by inserting this antenna coil into a reflow furnace and heating this antenna coil every substrate.

However, in the antenna coil mounted onto the substrate, the heating within the reflow furnace is not necessarily uniformly advanced and a temperature distribution is generated. Therefore, there is a case in which a warp is generated by its thermal stress. In this case, there are defects in that the coil side terminal portion is floated from the substrate side pad by this warp, and a soldering defect is easily caused.

SUMMARY OF THE INVENTION

In view of the above-described problem, it is an object of the present invention to provide a card type wireless device having a communication module. It is another object of the present invention to provide an antenna coil having high sensitivity and high antenna gain. It is further another object of the present invention to provide a manufacturing method of a communication module having an antenna coil.

An antenna coil includes: an air-core type flat coil body having a thickness in an axial direction of the coil body; a coil case made of resin; and a reinforce frame. The thickness of the coil body is smaller than a radius of a circle, an area of which is equal to an area of a region surrounded with an outline of a projected coil body, the projected coil body provided by projecting the coil body on a projection plane perpendicular to the axial direction of the coil body. The coil case has a ring shape, which corresponds to the coil body. The coil case includes a coil accommodation space for accommodating the coil body. The coil accommodation space is disposed in a circumferential direction of the ring shape of the coil case. The coil case further includes a coil side terminal for mounting the coil body on a substrate with a solder member. The reinforce frame is integrated with the coil case along with the circumferential direction of the ring shape of the coil case. The reinforce frame is made of a material having a Young' modulus higher than that of the resin of the coil case.

In the above antenna, since the reinforce frame is integrated with the resin coil case along with the circumferential direction of the coil case, the rigidity of the coil case is improved. This is because the reinforce frame is made of a material having a Young' modulus higher than that of the resin of the coil case. Thus, although the coil case has the air-core type flat ring shape corresponding to the coil body, the coil case is protected from warpage even when thermal stress is applied to the coil case in a solder reflow step. The solder reflow step is performed in a manufacturing process of the communication module having the antenna coil.

Accordingly, soldering failure ratio of the coil side terminal of the antenna coil is much reduced.

Further, a method for manufacturing a communication module having an antenna coil and a transmitting/receiving circuit, which are mounted on a substrate, is provided. The antenna coil is connected to the transmitting/receiving circuit. The method includes the steps of: positioning a coil side terminal of the antenna coil together with a solder member for connecting between a substrate side terminal of the substrate and the coil side terminal of the antenna coil; and heating the substrate together with the antenna coil in a solder reflow furnace so that the solder member is melted and soldered between the coil side terminal and the substrate side terminal.

In the above communication module, since the reinforce frame is integrated with the resin coil case along with the circumferential direction of the coil case, the rigidity of the coil case is improved. Thus, although the coil case has the air-core type flat ring shape corresponding to the coil body, the coil case is protected from warpage even when thermal stress is applied to the coil case in a solder reflow step. Accordingly, soldering failure ratio of the coil side terminal of the antenna coil is much reduced.

Further, a card type wireless device includes: a communication module having an antenna coil, a transmitting/receiving circuit connecting to the antenna coil, and a substrate; and a card type casing. The coil body includes an axis, which coincides with a normal line of the substrate, and the card type casing accommodates the communication module in such a manner that a thickness direction of the substrate coincides with a thickness direction of the card type casing.

In the above wireless device, since the reinforce frame is integrated with the resin coil case along with the circumferential direction of the coil case, the rigidity of the coil case is improved. Thus, although the coil case has the air-core type flat ring shape corresponding to the coil body, the coil case is protected from warpage even when thermal stress is applied to the coil case in a solder reflow step. Accordingly, soldering failure ratio of the coil side terminal of the antenna coil is much reduced. Further, the card type wireless device is suitably used for a wireless entry key of an automotive vehicle. Further, the card type wireless device is thin. Therefore, it is preferable to put the card type wireless device into a wallet or the like.

When a user carries the wireless device having the antenna coil together with the wallet and the like, a coin in the wallet may interrupt the antenna coil since the coin is a conductor having a large area. Thus, the sensitivity and the C-value of the antenna coil may be reduced. Here, the Q-value is a degree of selectivity of frequencies. However, even when the coin overlaps the principal surface of the card type wireless device, the antenna coil has sufficient area so that the coil does not interrupt the antenna coil completely. Further, the card type wireless device has high sensitivity.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

An embodiment mode of the invention will next be explained by using the drawings.

Figure 1:
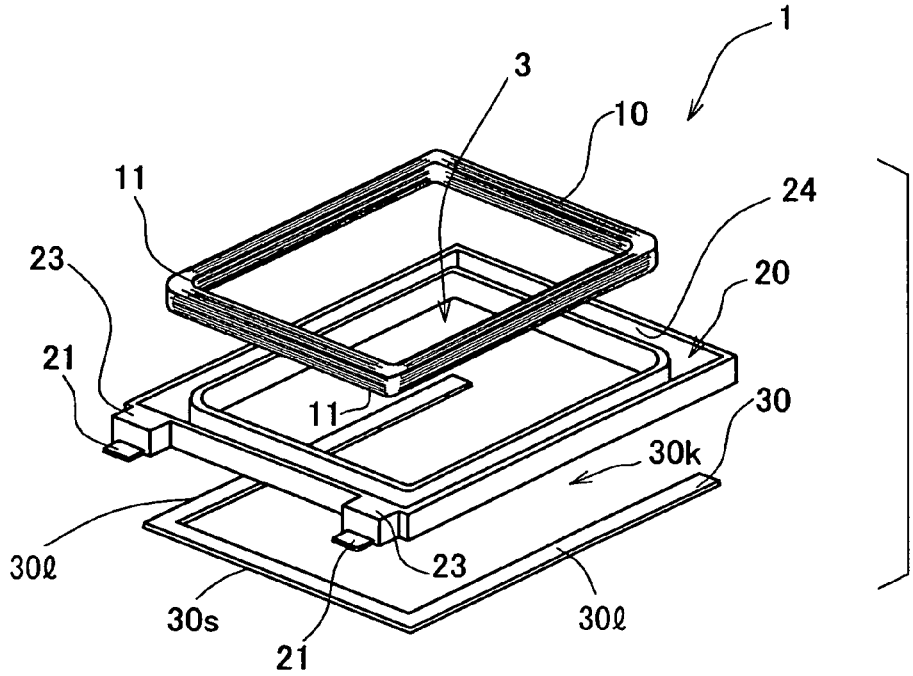
FIG. 1 is an exploded perspective view showing an antenna coil according to an embodiment of the present invention.

FIG. 1 shows an exploded perspective view of an antenna coil 1 as one example of the invention. FIGS. 2A to 2D are four face views (a plan view, a front view, a side view and a bottom view) of the antenna coil 1. The antenna coil 1 has a coil main body 10 of an air-core type of a flat shape, and a coil case 20 manufactured by resin. The coil case 20 is formed in a ring-shaped mode corresponding to the coil main body 10, and a coil storing portion 24 for storing this coil main body 10 is formed in the circumferential direction. The thickness of the coil main body 10 in its axial direction is set to be smaller than the radius of a circle of the same area as an area (planar outer shape area) surrounded by a self outer shape line at a projecting time to a projecting face perpendicular to this axis. "The coil main body 10 is formed in the flat shape" is "the thickness of the coil main body 10 in its axial direction is set so as to be smaller than the radius of the circle of the same area as the area (planar outer shape area) surrounded by the self outer shape line at the projecting time to the projecting face perpendicular to this axis." A coil side terminal portion 21 for soldering and mounting the coil main body 10 onto a substrate is arranged in the coil case 20. A reinforcing frame 30 constructed by a material higher in Young's modulus than resin is integrated along the circumferential direction of this coil case 20.

Figure 4:
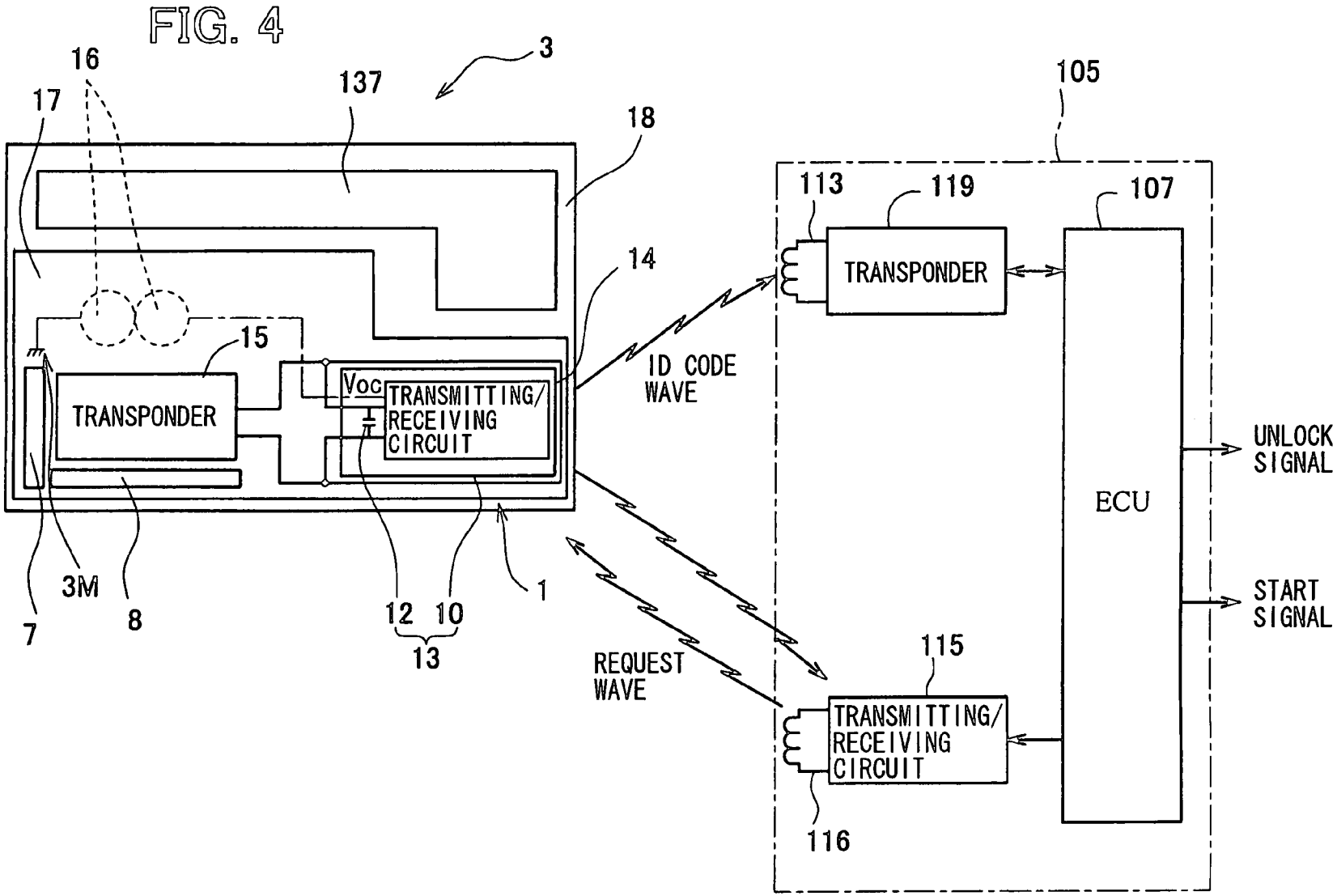
FIG. 4 is a schematic view showing a wireless key system having a card type wireless device.
Figure 5:
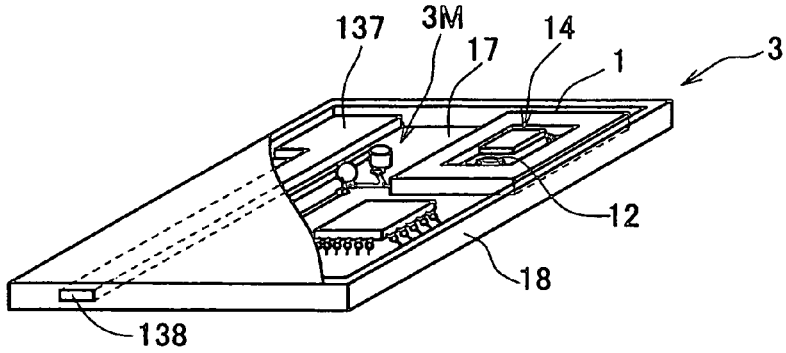
FIG. 5 is a partially cutaway perspective view showing the card type wireless device.

As shown in FIG. 4, the above antenna coil 1 is soldered and mounted to the substrate 17 together with a signal transmitting-receiving circuit 14 connected to this antenna coil 1 in a position relation in which the axis of the coil main body 10 is conformed to the normal direction of the substrate 17. Thus, a communication substrate module 3M is constructed. In this communication substrate module 3M, the antenna coil 1 constitutes an LF antenna 13 together with a capacitor 12 resonantly coupled to this antenna coil 1 in parallel. As shown in FIG. 5, this capacitor 12 and the signal transmitting-receiving circuit (IC) 14 are mounted to a substrate area on the inside of an air gap of the antenna coil 1. Further, a transponder circuit 15 is connected to the above LF antenna in parallel with the signal transmitting-receiving circuit 14. As shown in FIG. 5, the transponder circuit (IC) 15 is mounted to a substrate area outside the antenna coil 1. The signal transmitting-receiving circuit 14 and the transponder circuit 15 can be also constructed as an integral IC.

The coil axis of the antenna coil 1 is conformed to the normal direction of the substrate face so that directivity with respect to transmission and reception of a radio wave in this direction is raised. Separate coils 7, 8 having axes conformed to two independent directions within the substrate face may be also mounted to the substrate 17 (these coils 7, 8 are drawn by omitting connection wiring in FIG. 4, but each of these coils 7, 8 is connected to the antenna coil 1 in parallel).

As shown in FIG. 5, the above communication substrate module 3M is stored to a box body 18 of a card shape in a shape for conforming the thickness direction to the substrate 17 so that a card type wireless device 3 is constructed. This card type wireless device 3 is used as a wireless key for an automobile, and is advantageously stored into a purse, etc. since this card type wireless device 3 is thin. As shown in FIG. 4, a dry battery 16 as a driving power source of the signal transmitting-receiving circuit 14 is also stored to the box body 18. Further, a mechanical type key 137 for emergency is also stored to the box body 18, and can be detached from a slot 138 formed on the side face of the box body 18 as shown in FIG. 5.

As shown in FIG. 4, a body system ECU 107 of the automobile 105 periodically sends out a request radio wave for detecting approaching of a user carrying the card type wireless device 3 from an antenna 116 through a signal transmitting-receiving circuit 115 connected to this body system ECU 107. When the user approaches the automobile 105 within a constant distance, the LF antenna 13 built in the card type wireless device 3 receives this request radio wave. The signal transmitting-receiving circuit 14 receives this request radio wave and sends out an ID code for authentication by a radio wave of a prescribed frequency band. The automobile side body system ECU 107 receiving this ID code radio wave through the antenna 116 and the signal transmitting-receiving circuit 115 authenticates whether the sent ID is a correct ID. When the authentication is received, the body system ECU 107 outputs an unlock allowance signal for releasing the door lock and a starting allowance signal of an engine.

On the other hand, when the dry battery 16 of the card type wireless device 3 is consumed and no signal transmitting-receiving circuit 14 is operated, the request radio wave received by the LF antenna 13 is sent to the transponder circuit 15. In the transponder circuit 15, electromotive force excited in the antenna coil 10 by the request radio wave is set to electric power, and the transponder circuit 15 sends out an ID code radio wave from the LF antenna 13. In the automobile 105, this ID code radio wave is received by antennas 113 and 119, and processings after the authentication can be similarly performed. Namely, the transponder circuit of the card type wireless device 3 functions as a backup circuit at a battery running-out time.

When the above card type wireless device 3 is carried together with a purse, etc., there is a fear that a conductor of a comparatively large area such as a coin, etc. covers the antenna coil 1, and the sensitivity of the antenna and Q (frequency selecting degree) are reduced. However, even when a situation for overlapping the coin with the main surface of the card type wireless device 3 is supposed, it is possible to reduce the probability that the antenna coil 1 is perfectly covered with the coin, etc. as mentioned above if the antenna coil 1 is mounted to the substrate as a flat air-core type coil of a constant area or more as shown in FIG. 4. In its turn, the card type wireless device 3 of high sensitivity can be realized.

The planar outer shape of the card type wireless device 3 can be set to have short sides of 40 mm or more and 60 mm or less (e.g., 50 mm), and 75 mm or more and 95 mm or less (e.g., 85 mm), and a thickness of 2 mm or more and 5 mm or less (e.g., 4 mm) (e.g., this planar outer shape has about the same size as the size of a credit card). In the assembled antenna coil, the area of a planar outer shape area can be set to 8 $cm^2$ or more and 15 $cm^2$ or less (e.g., 12 $cm^2$). The width of the coil main body 10 at a projecting time to a projecting face perpendicular to the axis can be set to 1 mm or more and 4 mm or less (e.g., 3 mm). Further, the thickness of the coil case 20 in its axial direction can be set to 1 mm or more and 3 mm or less (e.g., 1.6 mm). As described later, in this embodiment mode, the antenna coil 1 is constructed so as to have a planar mode of a rectangular shape, and have a short side of 25 mm or more and 35 mm or less (e.g., 30 mm), and a long side of 35 mm or more and 45 mm or less (e.g., 40 mm).

Further, the diameter of a winding wire of the coil is set to 50 μm or more and 70 μm or less (a resin (e.g., polyurethane) coating wire having a coating thickness of 2 μm or more and 5 μm or less (e.g., 3 μm)). The number of turns is set to 200 or more and 300 or less (the intrinsic inductance of the coil main body 10 is set to 4 mH or more and 6 mH or less). The electrostatic capacity of the capacitor 12 is set to 300 pF or more and 400 pF or less (e.g., 350 pF). Thus, a resonance frequency of the LF antenna 13 can be adjusted to 100 kHz or more and 150 kHz or less (e.g., 134 kHz). The Q-value of the antenna is set to 18 to 21 and 100 to 110 dBμ/m in sensitivity can be realized.

Figure 6:
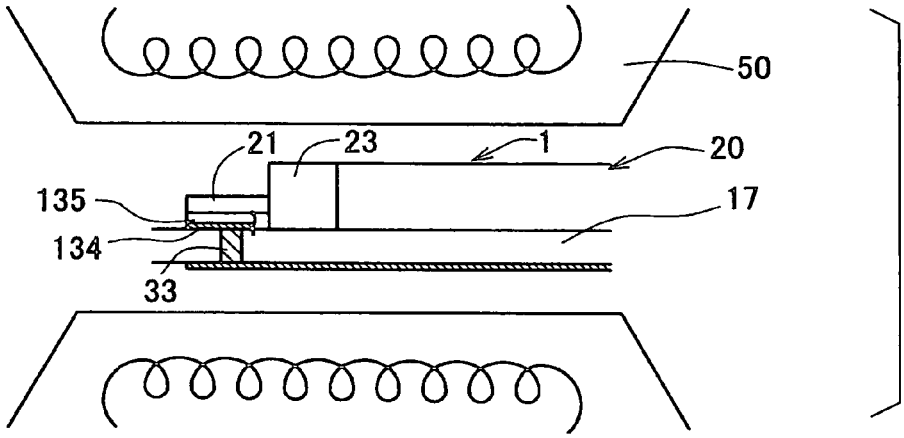
FIG. 6 is a schematic view explaining a method for manufacturing a communication module according to the embodiment of the present invention.
Figure 7A:
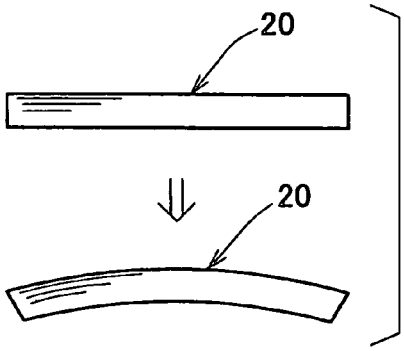
FIG. 7A is a schematic view explaining a warpage of a coil case in a reflow process.
Figure 7B:
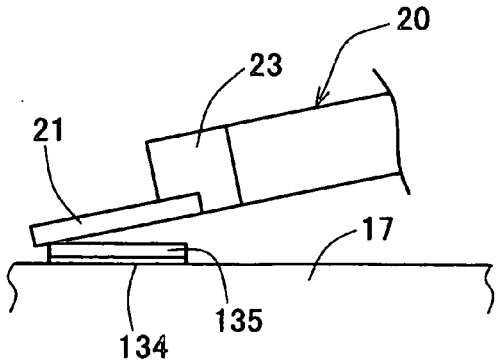
FIG. 7B is a schematic view showing soldering failure of the coil case.

As shown in FIG. 6, in the communication substrate module 3M used in the above card type wireless device 3, a coil side terminal portion 21 of the antenna coil 1 is positioned in a substrate side terminal portion (substrate side pad) 134 together with a soldering material 135 for connection. In its state, the substrate 17 is inserted into a reflow furnace 50 together with the antenna coil 1 positioned and placed on this substrate 17, and is heated. Thus, the soldering material 135 is melted and the coil side terminal portion 21 is soldered and connected to the substrate side terminal portion 134 so that the communication substrate module 3M is manufactured. At this time, as shown in FIGS. 7A and 7B, in an antenna case 20 on the substrate 17, heat transfer onto the substrate 17 side is easily advanced on the lower face side. On the other hand, a large amount of radiant heat from a furnace heat source is easily received on the upper face side. Accordingly, a rise in temperature of the upper face side is easily advanced so that a temperature gradient of the thickness direction is easily caused between the upper face side and the lower face side facing the substrate 17. Thus, in the coil case 20 manufactured by resin and having a high linear expansion coefficient, expansion displacement of the in-plane direction on the upper face side becomes greater than that on the lower face side so that a warp is easily caused in an upwardly convex mode. As its result, the coil side terminal portion 21 is floated from the substrate side pad (substrate side terminal portion) 134 by this warp so that a soldering defect is easily caused.

However, in accordance with the construction of the antenna coil 1 shown in FIGS. 1 and 2, the reinforcing frame 30 constructed by a material of a Young's modulus higher than that of resin is integrated along the circumferential direction of the coil case 20 manufactured by resin. Accordingly, rigidity of the coil case 20 can be raised. As its result, even when thermal stress is applied at the above solder reflow time, no coil case 20 is easily warped. In its turn, a soldering defect generating ratio of the coil side terminal portion 21 can be greatly reduced.

As shown in FIG. 6, the coil side terminal portion 21 is set to a terminal pad 21 for performing face-mounting onto the substrate as a mounting destination on the bottom face side of the coil case 20. A solder paste pattern formed by printing, etc. is arranged as the above solder material 135 between the terminal pad 21 and the substrate side pad 134. As shown in FIGS. 2A to 2D, the outer shape lines of the coil main body 10 and the coil case 20 are rectangular shapes, and the terminal pad 21 is arranged in a long side direction end portion of the coil case 20.

Figure 3A:
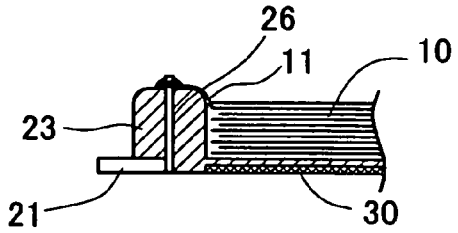
FIG. 3A is a cross sectional view showing the antenna coil taken along line IIIA-IIIA in FIG. 2A.
Figure 3B:
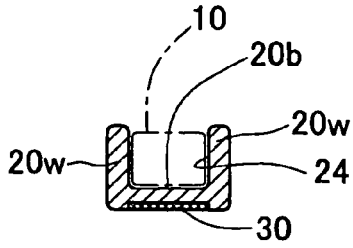
FIG. 3B is a cross sectional view showing the antenna coil taken along line IIIB-IIIB in FIG. 2A.
Figure 2A:
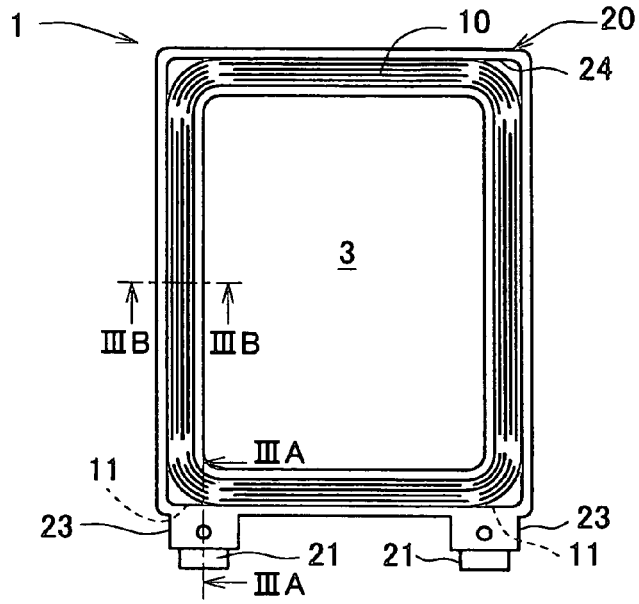
FIG. 2A is a front view.
Figure 2D:
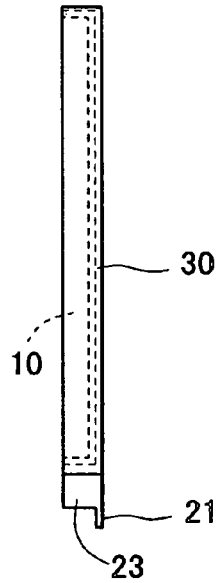
FIG. 2D is a side view showing the antenna coil in FIG. 1.
Figure 2B:
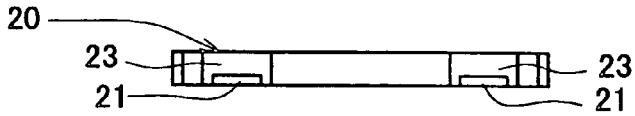
FIG. 2B is a bottom view.
Figure 2C:
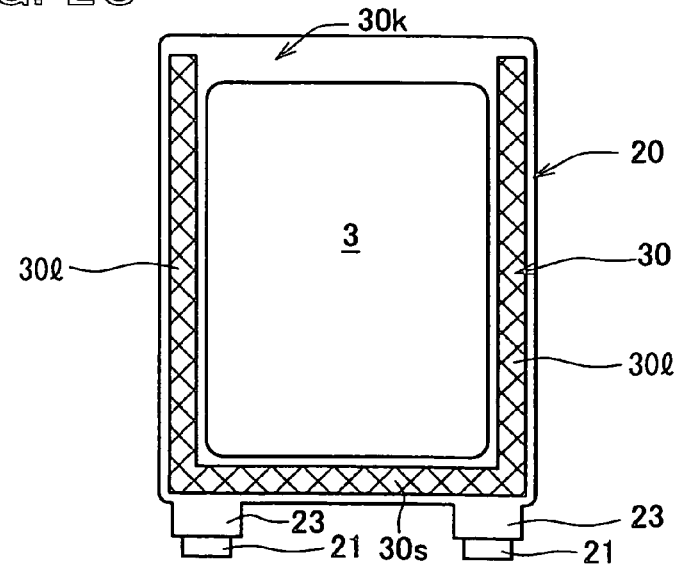
FIG. 2C is a backside view.

In FIGS. 2A to 2D, a coil storing portion 24 is formed in a groove shape opened to one end face in the axial direction of the coil case 20. As shown in FIGS. 3A and 3B, the reinforcing frame 30 is buried in the bottom portion 20*b* of the coil case 20 for forming the coil storing portion 24 of this groove shape. Concretely, the reinforcing frame 30 is buried to the bottom portion 20*b* of the coil case 20 by insert molding in a mode in which the outer face of the reinforcing frame 30 and the outer face of the bottom portion 20*b* become the same face.

The terminal pad 21 can be also arranged on the bottom face of the coil case 20. However, in this case, a lead portion 11 of the coil main body 10 must be connected to a position corresponding to the above terminal pad 21 of the bottom face of the coil storing portion 24 of a narrow width, and an assembly work of the coil main body 10 into the case becomes very complicated. Therefore, as shown in FIGS. 3A and 3B, in this embodiment mode, a pin burying portion 23 burying a connecting pin 26 thereinto in the axial direction is projected and formed on the outer circumferential face of the coil case 20. The lead portion 11 of the coil main body 10 is constructed so as to be connected to the upper end of the connecting pin 26 projected onto the top face of this pin burying portion 23. Thus, the assembly work becomes greatly easy. The terminal pad 21 is arranged on the bottom face of the pin burying portion 23, and a lower end portion of the connecting pin 26 is conducted to the terminal pad 21.

In the material of resin constituting the coil case 20, it is desirable to adopt a material able to be injection-molded and not easily softened and deformed even when a thermal hysteresis at the reflow time is applied. As a particularly preferable material from this viewpoint, polyphenylene sulfide (PPS: 282° C. in melting point, about 240° C. in upper limit temperature able to be continuously used, and 260° C. or more in thermal deformation temperature) is adopted in this embodiment mode. However, instead of this material, thermoplastic polyimide (melting point: 388° C.) can be also adopted.

In FIG. 1, the reinforcing frame 30 is set to a metallic frame (hereinafter also called the metallic frame 30). The metallic material is high in Young's modulus and is excellent in processing property, and it is easy to cope with a frame shape corresponding to the coil case 20 of an air-core type by punching processing, etc. Further, the frame sectional shapes of an L-shape and a C-shape can be also easily obtained by press working.

The metallic frame is a conductor. As shown by quoting FIG. 14, when the metallic frame is formed in a continuous ring shape mode (reference numeral 37) along the coil case 20, an electric current path turned around the axis of the coil main body 10 is formed. Accordingly, the problem that the metallic frame is inductively coupled to the coil main body 10 and the apparent inductance of the entire antenna coil is reduced, is caused. Namely, when a radio wave magnetic field H extending through the coil main body 10 is changed, an induced electric current is flowed to the metallic frame 30. The radio wave magnetic field relating to the antenna signal transmission and reception is canceled by its reverse magnetic field H' so that the apparent inductance is reduced. In particular, in the case of the LF antenna 13 shown in FIG. 4, the capacitor 12 adjusted in capacity so as to cause a resonance point at a desirable frequency with respect to the inductance of its coil main body 10 is connected to the antenna coil 1 in parallel. The Q-value of the antenna is determined by the characteristics of its LC parallel resonating circuit. However, when the metallic frame is formed in a mode as shown by reference numeral 37 of FIG. 14, the apparent inductance of the antenna coil is reduced by its induction coupling. The resonance point of the above LC parallel resonating circuit is shifted from the desirable frequency so that the Q-value and the antenna gain are greatly reduced. In this case, when an insulating portion 30*k* for partially dividing the electric current path turned around the axis of the coil main body 10 is arranged in an intermediate position in the circumferential direction of the metallic frame 30, the above disadvantages can be very effectively dissolved.

In the constructional material of the metallic frame 30, aluminum or an aluminum alloy is comparatively excellent in strength and corrosive property and is preferable in processing property and can be therefore preferably adopted in the invention. On the other hand, the constructional material of the metallic frame 30 can be also set to an iron system material. In this case, a non-magnetic material such as austenite system stainless steel can be also used (aluminum or the aluminum alloy is also non-magnetic), but an iron system soft magnetic material can be also adopted. The soft magnetic material is a ferromagnetic material and is high in magnetic permeability and a radio wave magnetic field relating to the antenna signal transmission and reception can be concentrated onto the metallic frame 30. Accordingly, it is possible to contribute to the improvements of sensitivity and gain of the antenna. As the iron system soft magnetic material, it is possible to adopt a silicon steel plate, general carbon steel, an Fe—Ni alloy (e.g., permalloy, etc.) or ferrite system stainless steel, etc. in addition to electromagnetic soft iron (it can be also said that the electromagnetic soft iron and the ferrite system stainless steel are advantageous from the viewpoint of processing property).

As shown in FIGS. 1 and 2, in the above metallic frame 30 arranged in a shape along the ring shape path set in the circumferential direction of the coil case 20, the above insulating portion 30*k* is set to a notch portion (hereinafter also called a notch portion 30*k*) in which the metallic frame 30 is notched at a partial interval of the arranging path. The insulating portion 30*k* for partially dividing an electric current conducting path of the circumferential direction can be simply formed by setting the metallic frame 30 to an ended shape instead of the continuous ring shape and spacing its end portions by a constant length and setting a notch mode.

Figure 8A:
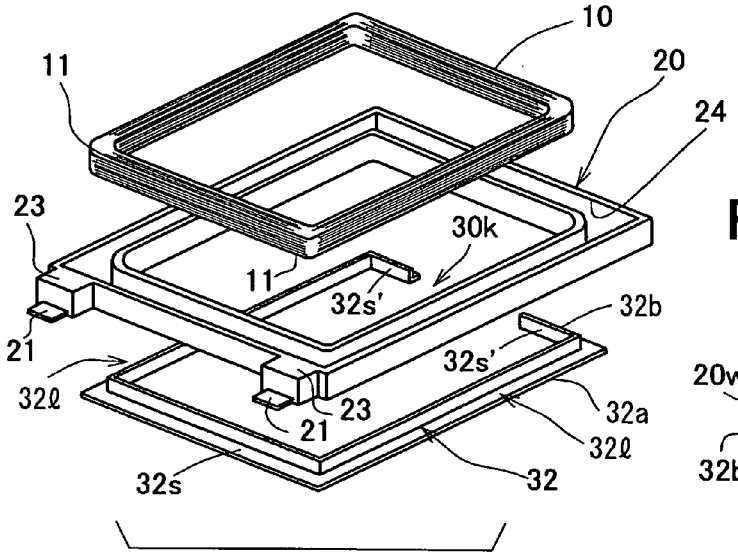
FIG. 8A is an exploded perspective view showing an antenna coil according to a first modification of the present invention.
Figure 8B:
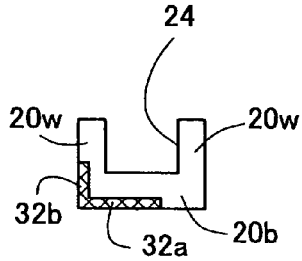
FIG. 8B is a cross sectional view showing the antenna coil in FIG. 8A.

In FIGS. 2A to 2D, the outer shape lines of the coil main body 10 and the coil case 20 are rectangular shapes, and the metallic frame 30 is arranged in a C-shape including one short side portion 30*s* corresponding to the outer shape line of the rectangular shape, and two long side portions 301 connected to both ends of this short side portion 30*s*. The above notch portion 30*k* is formed by using the entire interval on the remaining short side of the outer shape line of the rectangular shape. If the C-shaped portion provided by integrating the two long side portions 301 and the one short side portion 30*s* is formed in the metallic frame 30, rigidity with respect to twisting deformation of a frame face is raised in comparison with a case partially divided and formed on each side of the rectangular shape, and a warp causing the twisting deformation can be effectively restrained. As shown in FIGS. 8A and 8B, a partial interval of the remaining short side can be also used as the notch portion 30*k*.

A modified example of the antenna coil 1 of the invention will next be explained (portions common to FIGS. 2A to 2D are designated by the same reference numerals and their explanations are omitted). In FIGS. 8 and 9, metallic frames 32, 31 have main body portions 32*a*, 31*a* arranged in a C-shape on the bottom face of the coil case 20. In at least two long side portions 321, 311, reinforcing rib portions 32*b*, 31*c* exposed to the outer circumferential face or the inner circumferential face of the coil case 20 are integrated in the main body portions 32*a*, 31*a* in a shape forming an L-shaped section together with these main body portions 32*a*, 31*a*. Since the sectional shape of the metallic frame 30 is set to the L-shape correspondingly to the long side portion 301 of the coil case 20 easily amplified in warp displacement, its bending rigidity is raised and the warp deformation of the long side direction can be effectively restrained.

In FIGS. 8A and 8B, the reinforcing rib portion 32*b* is formed in a continuous C-shape laid across one short side portion 32*s* and two long side portions 321 connected to both ends of this short side portion 32*s*. When the reinforcing rib portion 32*b* is formed in this way, it is possible to further raise rigidity with respect to twisting deformation of the frame face made by the C-shaped portion. In FIGS. 8A and 8B, each of the main body portion 32*a* and the reinforcing rib portion 32*b* is formed in a shape laid across a partial interval 32*s*' constituting both end portions of the remaining short side portions from two long side portions 301 so that a reinforcing effect is further raised. The metallic frame 32 is integrated with the coil case 20 by insert molding such that the main body portion 32*a* has the same face as the outer face of the bottom portion 20*b* of the coil case 20 and the reinforcing rib portion 32*b* has the same face as the outer face of a side wall portion 20*w*. Here, the reinforcing rib portion 32*b* is arranged on the inner circumferential face side of the coil case 20*b*, but may be also arranged on the outer circumferential face side.

Figure 9A:
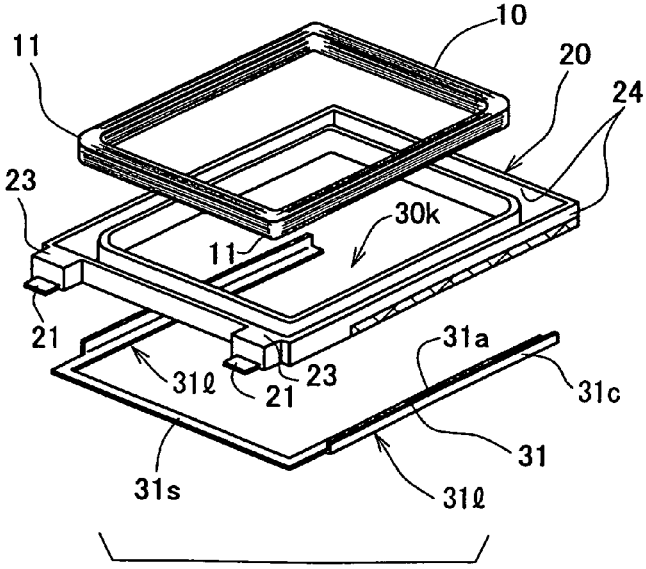
FIG. 9A is an exploded perspective view showing an antenna coil according to a second modification of the present invention.
Figure 9B:
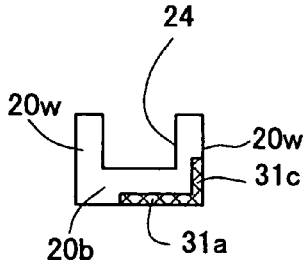
FIG. 9B is a cross sectional view showing the antenna coil in FIG. 9A.

On the other hand, in the construction of FIGS. 9A and 9B, the reinforcing rib portion 31*c* is arranged in only two long side portions 301 of the main body portion 31*a*. This mode has an advantage in that manufacture using press working, etc. is easy. Here, the reinforcing rib portion 31*c* is arranged on the outer circumferential face side of the coil case 20*b* (may be also reversely arranged).

Figure 10:
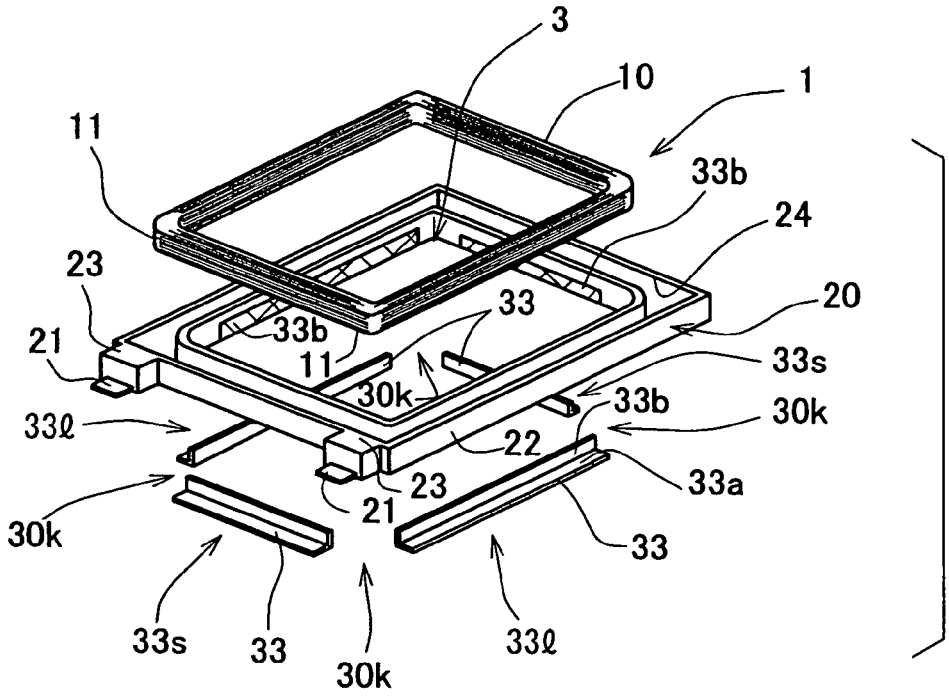
FIG. 10 is an exploded perspective view showing an antenna coil according to a third modification of the present invention.

In the construction of FIG. 10, a metallic frame 33 is constructed by forming notch portions 30*k* in four corner portions of the outer shape line of a rectangular shape, and dividing the metallic frame 33 into four portions constructed by two long side portions 331 and two short side portions 33*s* by this notch portion 30*k*. In accordance with this construction, there is an advantage able to reinforce all the four sides of the coil case 20 of the rectangular shape. In this case, the warp preventing effect can be further notably achieved by constructing each portion so as to have an L-shaped section which has a main body portion 33*a* arranged on the bottom face of the coil case 20, and also has a reinforcing rib portion 33*b* integrated with this main body portion 33*a* in a shape exposed to the inner circumferential face (or the outer circumferential face) of the coil case 20.

Figure 11:
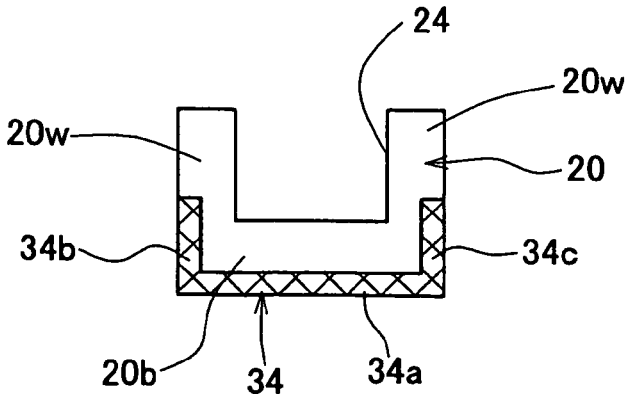
FIG. 11 is a cross sectional view showing an antenna coil according to a fourth modification of the present invention.

In the construction of each of FIGS. 8, 9 and 10, the metallic frame can be constructed so as to have the sectional shape of a C-shaped mode formed by integrating the main body portion 34*a* arranged in the bottom portion 20*b* of the coil case 20, and a pair of reinforcing rib portions 34*b*, 34*c* respectively arranged in two side wall portions 20*w* shown in FIG. 11.

Figure 12:
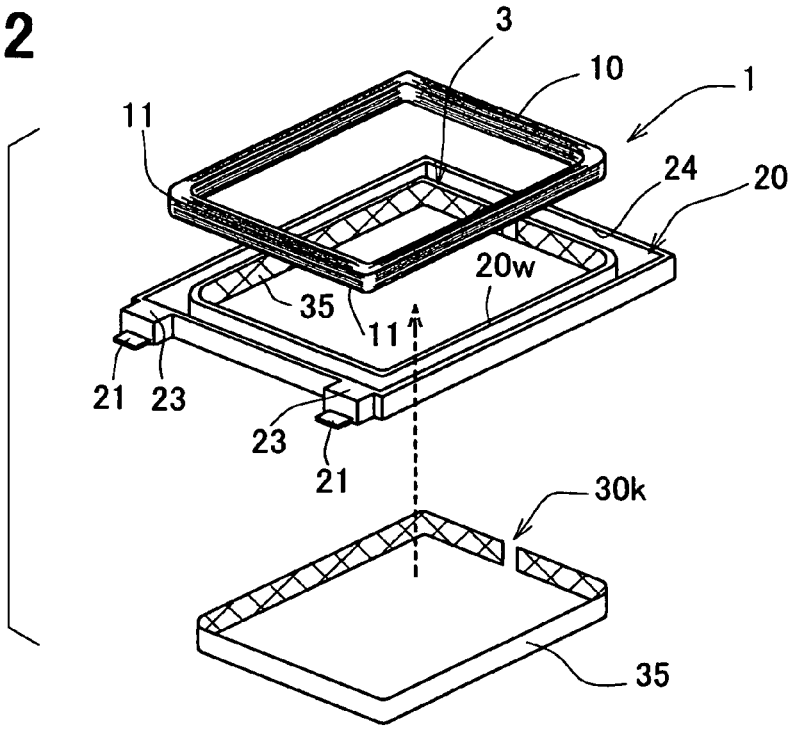
FIG. 12 is an exploded perspective view showing an antenna coil according to a fifth modification of the present invention.
Figure 13A:
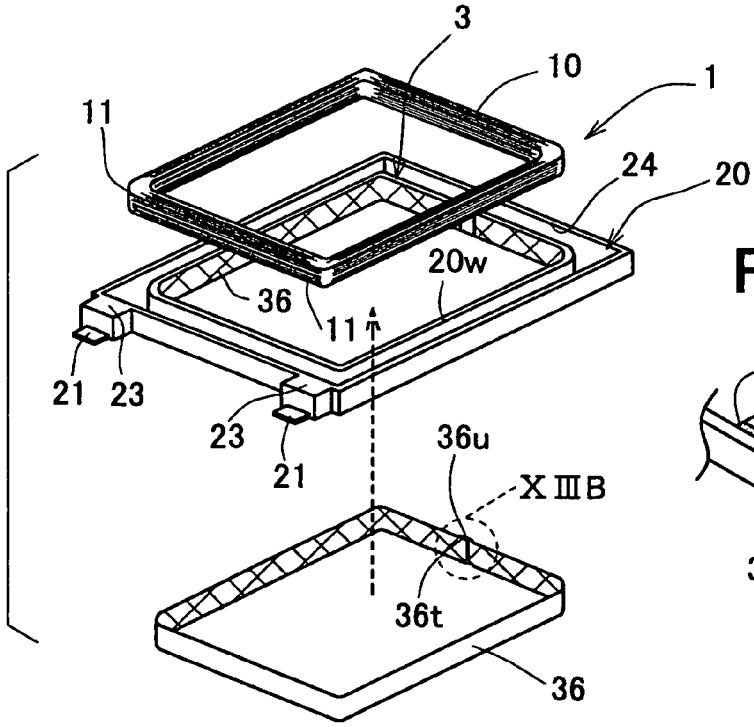
FIGS. 13A and 13B are exploded perspective views showing an antenna coil according to a sixth modification of the present invention.
Figure 13B:
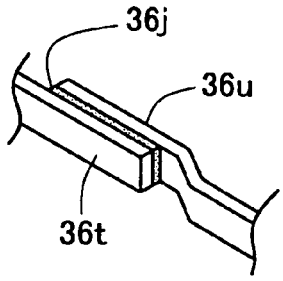

Further, in the constructions of FIGS. 12 and 13, the metallic frame 35 is formed so as to be buried in only the side wall portion 20*w* of the inner circumferential face side (the outer circumferential face side may be also set) of the coil case 20. In FIG. 12, the insulating portion is formed as the notch portion 30*k* of a slit shape. The metallic frame 36 of FIGS. 13A and 13B has a mode in which terminal portions 36*t*, 36*u* of a metallic member of an ended band shape are overlapped and an insulating adhesive layer 36*j* (resin or glass) is connected between both the terminal portions 36*t* and 36*u*. The adhesive layer 36*j* functions as an insulating portion. In accordance with this construction, since the ended metallic member is formed in a ring shape by adhesion, synthesis with respect to bending and twisting is greatly raised and the warp preventing effect is further notably shown.

Figure 14:
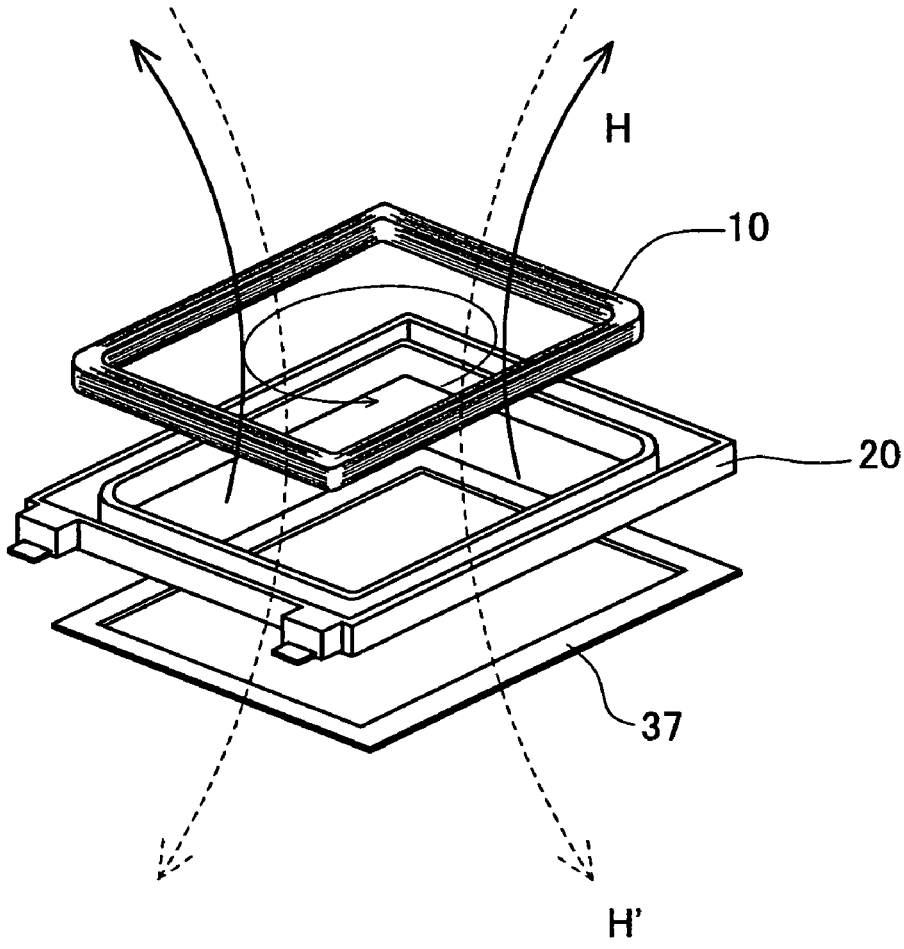
FIG. 14 is an exploded perspective view showing an antenna coil according to a seventh modification of the present invention.

Next, the material of the reinforcing frame is not particularly limited if the Young's modulus of this material is higher than that of resin constituting the coil case 20. For example, it is also possible to adopt an insulating inorganic material such as glass, ceramic of alumina, etc., sintering soft ferrite, etc. Further, the material of the reinforcing frame can be also constructed by a resin composite material strengthened by a filler of glass, ceramic, etc. In this case, since the reinforcing frame 37 becomes an insulator, there is no fear of a reduction in apparent inductance by inductive coupling to the coil main body 10 even when the reinforcing frame 37 is constructed in the mode of a continuous ring shape in the circumferential direction in the coil case 20 as shown in FIG. 14. Accordingly, it is excellent in the reinforcing effect of the coil case 20. In this case, when the reinforcing frame 37 is constructed by sintering soft ferrite and resin ferrite formed by resin-coupling soft ferrite powder, the radio wave magnetic field relating to the antenna signal transmission and reception can be concentrated onto the metallic frame 37. Accordingly, it is possible to contribute to the improvements of sensitivity and gain of the antenna.

The present inventions have the following aspects.

An antenna coil includes: an air-core type flat coil body having a thickness in an axial direction of the coil body; a coil case made of resin; and a reinforce frame. The thickness of the coil body is smaller than a radius of a circle, an area of which is equal to an area of a region surrounded with an outline of a projected coil body, the projected coil body provided by projecting the coil body on a projection plane perpendicular to the axial direction of the coil body. The coil case has a ring shape, which corresponds to the coil body. The coil case includes a coil accommodation space for accommodating the coil body. The coil accommodation space is disposed in a circumferential direction of the ring shape of the coil case. The coil case further includes a coil side terminal for mounting the coil body on a substrate with a solder member. The reinforce frame is integrated with the coil case along with the circumferential direction of the ring shape of the coil case. The reinforce frame is made of a material having a Young' modulus higher than that of the resin of the coil case.

In the above antenna, since the reinforce frame is integrated with the resin coil case along with the circumferential direction of the coil case, the rigidity of the coil case is improved. This is because the reinforce frame is made of a material having a Young' modulus higher than that of the resin of the coil case. Thus, although the coil case has the air-core type flat ring shape corresponding to the coil body, the coil case is protected from warpage even when thermal stress is applied to the coil case in a solder reflow step. The solder reflow step is performed in a manufacturing process of the communication module having the antenna coil. Accordingly, soldering failure ratio of the coil side terminal of the antenna coil is much reduced.

Alternatively, the coil accommodation space may be a groove with an opening, which is disposed on one side of the coil case in the axial direction. The coil case may further include a bottom and a pair of sidewalls so that the bottom and the sidewalls provide the coil accommodation space. The reinforce frame may be embedded in at least one of the bottom and the sidewalls. In this case, the coil body, which is formed in another process for winding, is easily accommodated and mounted in the coil accommodation space from the opening of the groove. Further, in this case, the reinforce frame can be embedded in the bottom or the sidewall of the coil case. The coil case provides the coil accommodation space.

Alternatively, the reinforce frame may include an outside surface, which coincides with an outside surface of the bottom or the sidewalls, and the reinforce frame may be insert-molded in at least one of the bottom and the sidewalls. Thus, the reinforce frame is integrated with the coil case, and the manufacturing method of the antenna coil is simplified.

Alternatively, the reinforce frame may be embedded in the bottom and the sidewalls. In this case, the cross section of the reinforce frame is a L-shape or a C-shape, which is provided by the bottom and the sidewall of the reinforce frame. Thus, bending strength of the reinforce frame is improved. Accordingly, the coil case is protected from warpage sufficiently.

Alternatively, the coil side terminal of the coil case may be a terminal pad for surface mounting the coil case on the substrate, and the bottom of the coil case may be mounted on the substrate. In this case, the antenna coil provides as a surface mounting part for performing automatic mounting process. Conventionally, since only a solder paste pattern is formed between the terminal pad of an antenna coil side and a substrate side pad of a substrate side by a printing method or the like, the soldering failure may be occurred when the solder paste pattern is melted in a solder reflow step. This is because the melted solder paste pattern does not have sufficient resistance to prevent a displacement of the terminal pad of the antenna coil side from the substrate pad. However, in the above antenna coil, the coil case is protected from warpage so that the ratio of soldering failure is reduced.

Alternatively, the coil body may have an outline, which has a rectangular shape, and the coil case may have an outline, which has a rectangular shape. The terminal pad may be disposed on one of short sides of the rectangular shape of the coil case. In this case, the warpage on the short side is smaller than that on the long side so that soldering failure is much prevented.

Alternatively, the coil case may further include a pin embedded portion and a connection pin. The pin embedded portion may protrude from an outer circumference of the coil case. The connection pin may be embedded in the pin embedded portion along with the axial direction of the coil case. The connection pin may include a top and a bottom, which are exposed from the pin embedded portion. The top of the connection pin may be exposed on a top surface of the pin embedded portion in the axial direction of the coil case. The bottom of the connection pin may be exposed on a bottom surface of the pin embedded portion in the axial direction of the coil case. The top of the connection pin may be electrically connected to a lead terminal of the coil body. The terminal pad may be disposed on the bottom surface of the pin embedded portion so that the bottom of the connection pin is electrically connected to the terminal pad.

Alternatively, the reinforce frame may be made of another material such as glass, ceramics such as alumina, insulation inorganic material such as sintered soft ferrite. Further, the reinforce frame may be made of resin complex material including a filler of glass or ceramics.

Alternatively, the reinforce frame may be made of metal. The reinforce frame may include an insulation portion for dividing a current path of the reinforce frame, which surrounds around an axis of the coil body. The insulation portion of the reinforce frame may be disposed at an intermediate part of the reinforce frame in a circumferential direction of the reinforce frame. The metal has high Young's modulus and excellent machinability so that the reinforce frame having a shape corresponding to the air-core type coil case is easily formed by a punching method or the like. Further, the frame shape can be easily formed to be a L-shape or a C-shape by using a press method.

Alternatively, the reinforce frame may be made of aluminum or aluminum alloy. Alternatively, the reinforce frame may be made of iron soft magnetic material.

When the reinforce frame is made of metal, the frame provides a current path surrounding around the axis of the coil body in a case where the frame provides a ring shape along with the coil case. This is because the metal is a conductor. Therefore, the current path is inductively coupled with the coil body, so that an apparent inductance of whole antenna coil is reduced. Specifically, when the magnetic field of an electric wave penetrating through the coil body is deviated, or changed, inductive current flows through the reinforce frame. Inverse magnetic field corresponding to the inductive current cancels the magnetic field of the electric wave regarding transmission or reception of the antenna, so that the apparent inductance of the antenna is reduced. Especially, when the antenna is a LF type antenna, the antenna coil connects to a capacitor in parallel. Here, the capacitor has a capacitance to adjusted to generate resonance at a predetermined frequency. The capacitance is adjusted in accordance with the inductance of the coil body. Thus, the Q-value of the antenna is determined on the basis of the characteristics of a LC parallel resonant circuit. However, when the metallic reinforce frame causes the inductive coupling, the apparent inductance of the antenna coil is reduced, so that the resonant frequency is deviated from the predetermined frequency. Thus, the Q-value and the antenna gain are much reduced. In this case, it is considered that the current path surrounding around the coil body is divided. Thus, alternatively, the reinforce frame may be disposed along with the ring shape of the coil case so that the reinforce frame has a ring shape. The insulation portion of the reinforce frame may be provided by a notch of the reinforce frame. The notch of the reinforce frame may be disposed in a part of the ring shape of the reinforce frame. In this case, the notch prevents the current path, so that the resonant frequency is not deviated from the predetermine frequency.

Alternatively, the coil body may have an outline, which has a rectangular shape. The coil case may have an outline, which has a rectangular shape. The reinforce frame may have a C-shape so that the C-shape of the reinforce frame is provided by one of short sides and two long sides of the rectangular shape of the coil case. The notch of the reinforce frame may be disposed on a part of or whole of the other one of the short sides of the rectangular shape of the coil case.

Alternatively, the reinforce frame may include a main part having a C-shape and a rib. The main part of the reinforce frame may be disposed on the bottom of the coil case. The reinforce frame may have a L-shaped cross section perpendicular to the circumferential direction of the ring shape of the coil case. The rib may be disposed on an outer circumferential surface or an inner circumferential surface of the coil case so that the rib and the main part of the reinforce frame provide the L-shaped cross section. The rib may be disposed on at least two long sides of the rectangular shape of the coil case.

Alternatively, the rib may be only disposed on two long sides of the rectangular shape of the coil case.

Alternatively, the rib may be disposed on two long sides and one short side of the rectangular shape of the coil case so that the rib provides a C-shape.

Alternatively, the rib and the main part of the reinforce frame may be disposed on two long sides, one short side and a part of the other one short side of the rectangular shape of the coil case.

Alternatively, the reinforce frame may include four parts. Each part of the reinforce frame may include a main part and a rib, which are integrated each other. The main part of each part of the reinforce frame may be disposed on the bottom of the coil case. Each part of the reinforce frame may have a L-shaped cross section perpendicular to the circumferential direction of the ring shape of the coil case. The rib of each part of the reinforce frame may be disposed on an outer circumferential surface or an inner circumferential surface of the coil case so that the rib and the main part in each part of the reinforce frame provide the L-shaped cross section. The reinforce frame may be divided into four parts by four notches so that four parts of the reinforce frame are disposed on two long sides and two short sides of the rectangular shape of the coil case, respectively. Each notch may be disposed at a corner of the rectangular shape of the coil case.

Further, a method for manufacturing a communication module having an antenna coil and a transmitting/receiving circuit, which are mounted on a substrate, is provided. The antenna coil is connected to the transmitting/receiving circuit. The method includes the steps of: positioning a coil side terminal of the antenna coil together with a solder member for connecting between a substrate side terminal of the substrate and the coil side terminal of the antenna coil; and heating the substrate together with the antenna coil in a solder reflow furnace so that the solder member is melted and soldered between the coil side terminal and the substrate side terminal.

In the above communication module, since the reinforce frame is integrated with the resin coil case along with the circumferential direction of the coil case, the rigidity of the coil case is improved. Thus, although the coil case has the air-core type flat ring shape corresponding to the coil body, the coil case is protected from warpage even when thermal stress is applied to the coil case in a solder reflow step. Accordingly, soldering failure ratio of the coil side terminal of the antenna coil is much reduced.

Further, a card type wireless device includes: a communication module having an antenna coil, a transmitting/receiving circuit connecting to the antenna coil, and a substrate; and a card type casing. The coil body includes an axis, which coincides with a normal line of the substrate, and the card type casing accommodates the communication module in such a manner that a thickness direction of the substrate coincides with a thickness direction of the card type casing.

In the above wireless device, since the reinforce frame is integrated with the resin coil case along with the circumferential direction of the coil case, the rigidity of the coil case is improved. Thus, although the coil case has the air-core type flat ring shape corresponding to the coil body, the coil case is protected from warpage even when thermal stress is applied to the coil case in a solder reflow step. Accordingly, soldering failure ratio of the coil side terminal of the antenna coil is much reduced. Further, the card type wireless device is suitably used for a wireless entry key of an automotive vehicle. Further, the card type wireless device is thin. Therefore, it is preferable to put the card type wireless device into a wallet or the like.

When a user carries the wireless device having the antenna coil together with the wallet and the like, a coin in the wallet may interrupt the antenna coil since the coin is a conductor having a large area. Thus, the sensitivity and the C-value of the antenna coil may be reduced. Here, the Q-value is a degree of selectivity of frequencies. However, even when the coin overlaps the principal surface of the card type wireless device, the antenna coil has sufficient area so that the coil does not interrupt the antenna coil completely. Further, the card type wireless device has high sensitivity.

While the invention has been described with reference to preferred embodiments thereof, it is to be understood that the invention is not limited to the preferred embodiments and constructions. The invention is intended to cover various modification and equivalent arrangements. In addition, while the various combinations and configurations, which are preferred, other combinations and configurations, including more, less or only a single element, are also within the spirit and scope of the invention.

What is claimed is:

1. An antenna coil comprising:

an air-core type flat coil body having a thickness in an axial direction of the coil body;

a coil case made of resin; and a reinforce frame, wherein the thickness of the coil body is smaller than a radius of a circle, an area of which is equal to an area of a region surrounded with an outline of a projected coil body, the projected coil body provided by projecting the coil body on a projection plane perpendicular to the axial direction of the coil body, the coil case has a ring shape, which corresponds to the coil body, the coil case includes a coil accommodation space for accommodating the coil body, the coil accommodation space is disposed in a circumferential direction of the ring shape of the coil case, the coil case further includes a coil side terminal for mounting the coil body on a substrate with a solder member, the reinforce frame is integrated with the coil case along with the circumferential direction of the ring shape of the coil case, and the reinforce frame is made of a material having a Young' modulus higher than that of the resin of the coil case.

2. The antenna coil according to claim 1, wherein the coil accommodation space is a groove with an opening, which is disposed on one side of the coil case in the axial direction, the coil case further includes a bottom and a pair of sidewalls so that the bottom and the sidewalls provide the coil accommodation space, and the reinforce frame is embedded in at least one of the bottom and the sidewalls.

3. The antenna coil according to claim 2, wherein the reinforce frame includes an outside surface, which coincides with an outside surface of the bottom or the sidewalls, and the reinforce frame is insert-molded in at least one of the bottom and the sidewalls.

4. The antenna coil according to claim 3, wherein the reinforce frame is embedded in the bottom and the sidewalls.

5. The antenna coil according to claim 2, wherein the coil side terminal of the coil case is a terminal pad for surface mounting the coil case on the substrate, and the bottom of the coil case is mounted on the substrate.

6. The antenna coil according to claim 5, wherein the coil body has an outline, which has a rectangular shape, the coil case has an outline, which has a rectangular shape, and the terminal pad is disposed on one of short sides of the rectangular shape of the coil case.

7. The antenna coil according to claim 6, wherein the coil case further includes a pin embedded portion and a connection pin, the pin embedded portion protrudes from an outer circumference of the coil case, the connection pin is embedded in the pin embedded portion along with the axial direction of the coil case, the connection pin includes a top and a bottom, which are exposed from the pin embedded portion, the top of the connection pin is exposed on a top surface of the pin embedded portion in the axial direction of the coil case, the bottom of the connection pin is exposed on a bottom surface of the pin embedded portion in the axial direction of the coil case, the top of the connection pin is electrically connected to a lead terminal of the coil body, and the terminal pad is disposed on the bottom surface of the pin embedded portion so that the bottom of the connection pin is electrically connected to the terminal pad.

8. The antenna coil according to claim 2, wherein the reinforce frame is made of metal, the reinforce frame includes an insulation portion for dividing a current path of the reinforce frame, which surrounds around an axis of the coil body, and the insulation portion of the reinforce frame is disposed at an intermediate part of the reinforce frame in a circumferential direction of the reinforce frame.

9. The antenna coil according to claim 8, wherein the reinforce frame is made of aluminum or aluminum alloy.

10. The antenna coil according to claim 8, wherein the reinforce frame is made of iron soft magnetic material.

11. The antenna coil according to claim 8, wherein the reinforce frame is disposed along with the ring shape of the coil case so that the reinforce frame has a ring shape, the insulation portion of the reinforce frame is provided by a notch of the reinforce frame, and the notch of the reinforce frame is disposed in a part of the ring shape of the reinforce frame.

12. The antenna coil according to claim 11, wherein the coil body has an outline, which has a rectangular shape, the coil case has an outline, which has a rectangular shape, the reinforce frame has a C-shape so that the C-shape of the reinforce frame is provided by one of short sides and two long sides of the rectangular shape of the coil case, and the notch of the reinforce frame is disposed on a part of or whole of the other one of the short sides of the rectangular shape of the coil case.

13. The antenna coil according to claim 1, wherein the reinforce frame includes a main part having a C-shape and a rib, the main part of the reinforce frame is disposed on the bottom of the coil case, the reinforce frame has a L-shaped cross section perpendicular to the circumferential direction of the ring shape of the coil case, the rib is disposed on an outer circumferential surface or an inner circumferential surface of the coil case so that the rib and the main part of the reinforce frame provide the L-shaped cross section, and the rib is disposed on at least two long sides of the rectangular shape of the coil case.

14. The antenna coil according to claim 13, wherein the rib is only disposed on two long sides of the rectangular shape of the coil case.

15. The antenna coil according to claim 13, wherein the rib is disposed on two long sides and one short side of the rectangular shape of the coil case so that the rib provides a C-shape.

16. The antenna coil according to claim 13, wherein the rib and the main part of the reinforce frame are disposed on two long sides, one short side and a part of the other one short side of the rectangular shape of the coil case.

17. The antenna coil according to claim 2, wherein the reinforce frame includes four parts, each part of the reinforce frame includes a main part and a rib, which are integrated each other, the main part of each part of the reinforce frame is disposed on the bottom of the coil case, each part of the reinforce frame has a L-shaped cross section perpendicular to the circumferential direction of the ring shape of the coil case, the rib of each part of the reinforce frame is disposed on an outer circumferential surface or an inner circumferential surface of the coil case so that the rib and the main part in each part of the reinforce frame provide the L-shaped cross section, the reinforce frame is divided into four parts by four notches so that four parts of the reinforce frame are disposed on two long sides and two short sides of the rectangular shape of the coil case, respectively, and each notch is disposed at a corner of the rectangular shape of the coil case.

18. A method for manufacturing a communication module having an antenna coil and a transmitting/receiving circuit, which are mounted on a substrate, wherein the antenna coil is connected to the transmitting/receiving circuit, the method comprising the steps of:

positioning a coil side terminal of the antenna coil together with a solder member for connecting between a substrate side terminal of the substrate and the coil side terminal of the antenna coil; and heating the substrate together with the antenna coil in a solder reflow furnace so that the solder member is melted and soldered between the coil side terminal and the substrate side terminal, wherein the antenna coil further includes:

an air-core type flat coil body having a thickness in an axial direction of the coil body;

a coil case made of resin; and a reinforce frame, the thickness of the coil body is smaller than a radius of a circle, an area of which is equal to an area of a region surrounded with an outline of a projected coil body, the projected coil body provided by projecting the coil body on a projection plane perpendicular to the axial direction of the coil body, the coil case has a ring shape, which corresponds to the coil body, the coil case includes a coil accommodation space for accommodating the coil body, the coil accommodation space is disposed in a circumferential direction of the ring shape of the coil case, the coil case further includes a coil side terminal for mounting the coil body on a substrate with a solder member, the reinforce frame is integrated with the coil case along with the circumferential direction of the ring shape of the coil case, and the reinforce frame is made of a material having a Young' modulus higher than that of the resin of the coil case.

19. A card type wireless device comprising:

a communication module having an antenna coil, a transmitting/receiving circuit connecting to the antenna coil, and a substrate; and a card type casing, wherein the antenna coil includes:

an air-core type flat coil body having a thickness in an axial direction of the coil body;

a coil case made of resin; and a reinforce frame, the thickness of the coil body is smaller than a radius of a circle, an area of which is equal to an area of a region surrounded with an outline of a projected coil body, the projected coil body provided by projecting the coil body on a projection plane perpendicular to the axial direction of the coil body, the coil case has a ring shape, which corresponds to the coil body, the coil case includes a coil accommodation space for accommodating the coil body, the coil accommodation space is disposed in a circumferential direction of the ring shape of the coil case, the coil case further includes a coil side terminal for mounting the coil body on a substrate with a solder member, the reinforce frame is integrated with the coil case along with the circumferential direction of the ring shape of the coil case, the reinforce frame is made of a material having a Young' modulus higher than that of the resin of the coil case, the antenna coil and the transmitting/receiving circuit are mounted on the substrate, the coil body includes an axis, which coincides with a normal line of the substrate, and the card type casing accommodates the communication module in such a manner that a thickness direction of the substrate coincides with a thickness direction of the card type casing.

* * * * *